US008348105B2

(12) United States Patent
Wong et al.

(10) Patent No.: US 8,348,105 B2
(45) Date of Patent: Jan. 8, 2013

(54) COMPACT AUTOMATIC HOMOGENIZED LIQUID DETERGENT DISPENSING DEVICE

(75) Inventors: Ying Man John Wong, Shatin (HK); Kwok Yung Anthony Law, Shatin (HK)

(73) Assignee: Raymond Industrial Limited, Shatin, N.T., Hong Kong (CN)

( * ) Notice: Subject to any disclaimer, the term of this patent is extended or adjusted under 35 U.S.C. 154(b) by 615 days.

(21) Appl. No.: 12/583,439

(22) Filed: Aug. 20, 2009

(65) Prior Publication Data

US 2010/0051642 A1 Mar. 4, 2010

Related U.S. Application Data

(60) Provisional application No. 61/190,860, filed on Sep. 3, 2008.

(51) Int. Cl.
*B65D 88/54* (2006.01)

(52) U.S. Cl. ..... 222/333; 222/190

(58) Field of Classification Search ..... 222/52, 222/190, 80–83, 333, 325, 135, 145.6
See application file for complete search history.

(56) References Cited

U.S. PATENT DOCUMENTS

| | | | | |
|---|---|---|---|---|
| 4,743,430 | A * | 5/1988 | Spielholz | 422/133 |
| 5,544,788 | A * | 8/1996 | Meyer | 222/110 |
| 7,191,920 | B2 * | 3/2007 | Boll et al. | 222/333 |
| 7,766,194 | B2 * | 8/2010 | Boll et al. | 222/333 |
| 7,837,132 | B2 * | 11/2010 | Mazooji et al. | 239/263.1 |
| 8,002,151 | B2 * | 8/2011 | Matthews et al. | 222/190 |
| 2005/0139612 | A1 * | 6/2005 | Matthews et al. | 222/190 |
| 2011/0017778 | A1 * | 1/2011 | Kadiks et al. | 222/190 |

* cited by examiner

*Primary Examiner* — Lien Ngo
(74) *Attorney, Agent, or Firm* — Alix, Yale & Ristas, LLP

(57) ABSTRACT

A foam dispensing device creates and dispenses foam from a source of liquid. The device employs a mixing chamber upstream of a unit of porous material and an outlet. When activated, a single motor powers a liquid pump and an air pump. The liquid pump transports liquid from a source to the mixing chamber. The air pump propels air through the mixing chamber wherein the air becomes pressurized. The liquid and air mix within in the mixing chamber. The liquid-air mixture is propelled through the porous material by the flow of air, creating a foam that is dispensed from the outlet.

17 Claims, 4 Drawing Sheets

COMPACT AUTOMATIC HOMOGENIZED LIQUID DETERGENT DISPENSING DEVICE

CROSS REFERENCE TO RELATED APPLICATION

This application claims the benefit of U.S. Provisional Application No. 61/190,860, filed Sep. 3, 2008 for "COMPACT AUTOMATIC HOMOGENIZED LIQUID DETERGENT DISPENSING DEVICE", the disclosure of which is incorporated by reference in its entirety.

FIELD

The present disclosure relates generally to a foam dispenser for soaps and the like, and more particularly to a compact multiple pump foam dispenser that produces and dispenses foam from a liquid source.

BACKGROUND

Soap in the form of foam is a popular consumer product for use in both domestic and commercial environments. Most known devices require sources of pressurized soap already in the form of a foam. Such cartridges are relatively expensive and are more prone to heat and compression damage as compared to conventional liquid soap. Consequently, there exists a need for a compact automatic foam dispensing device that can produce foam from liquid soap.

SUMMARY

A novel foam dispensing device that produces and dispenses foam from an insert of ordinary liquid soap.

A liquid foam dispenser has a liquid source in fluid communication with a nozzle defining an outlet. A first pump is adapted to propel liquid from the source to the nozzle. A second pump is adapted to propel air to the nozzle. A single motor is in drive engagement with both the first and second pumps. When activated, the motor drives the first and second pumps simultaneously. A mixing chamber is positioned between the liquid source and the outlet. A unit of porous material is positioned between the mixing chamber and the outlet. Liquid and air are propelled via the first and second pumps and mix within the mixing chamber. Flowing air from the second pump propels the air-liquid mixture from the mixing chamber through the unit of porous material to form a foam. The foam is dispensed from the outlet.

The liquid source can be a replaceable cartridge of liquid soap. The dispenser can have a receiving unit with a locking mechanism for locking the replaceable cartridge therein. The motor can be activated by an electronic trigger mechanism. The electronic trigger mechanism can be a motion-detecting sensor. More particularly, the motion-detecting sensor can be a break beam detector.

The first pump is a peristaltic pump. The second pump is a displacement pump. The second pump delivers air at a pressure of at least 4 psi. The porous material has pores of about 50 μm to about 2 mm.

BRIEF DESCRIPTION OF THE DRAWINGS

In the accompanying drawing, like elements are numbered alike in the several Figures.

DETAILED DESCRIPTION

Figure 1:
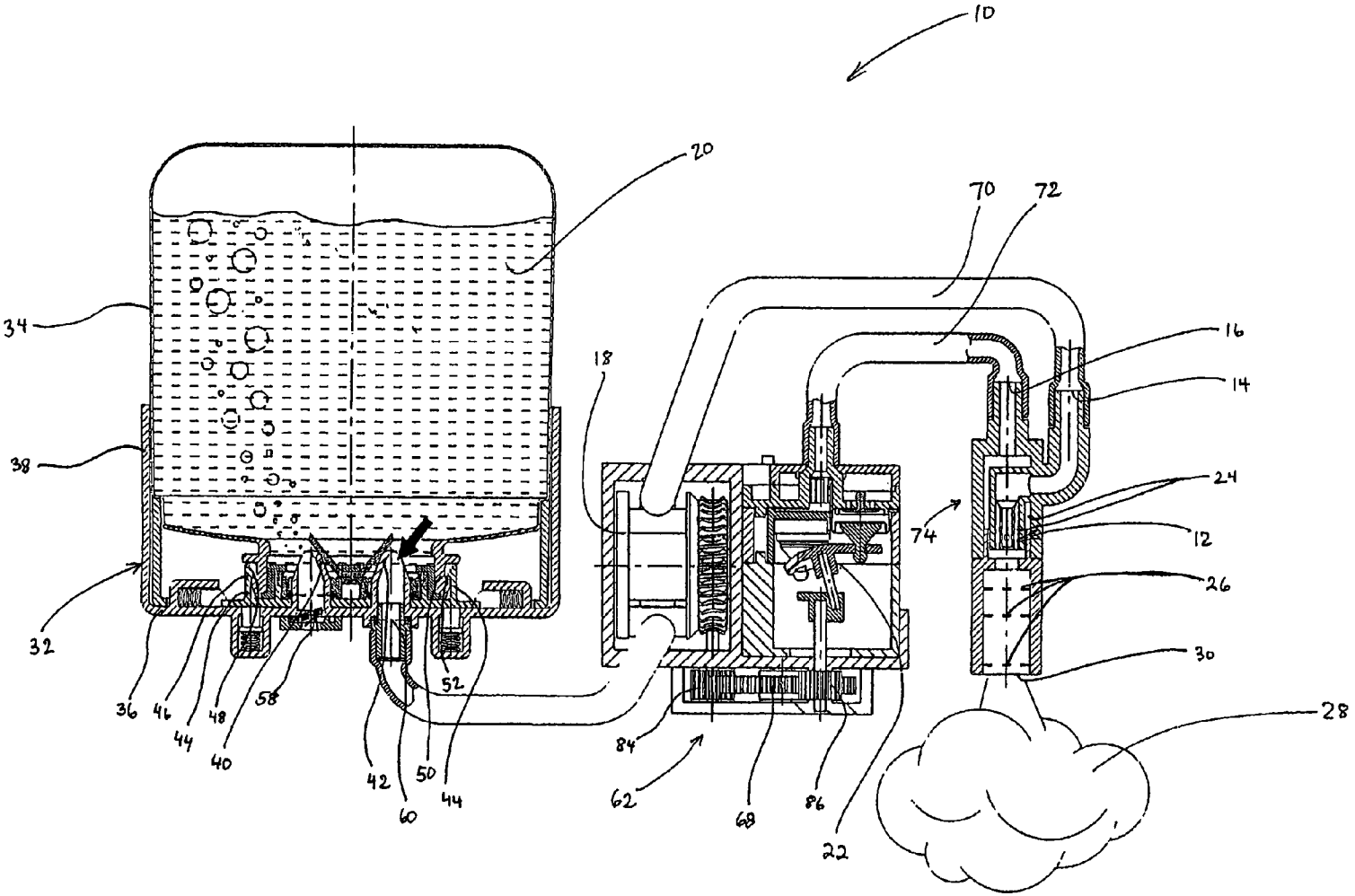
FIG. 1 is a longitudinal sectional view, partly broken away and partly in schematic, of a dispenser.

With reference to the drawings wherein like numerals represent like parts throughout the several embodiments, a foam dispensing device 10 is preferably tailored for foaming commercially available liquid soaps, though it is not limited as such. Embodiments of the foam dispensing device produce and dispense foam from liquid quickly and efficiently. The foam dispensing device is appropriate for domestic, commercial and public environments.

Generally, the foam dispensing device comprises a liquid source 20 in communication with a mixing chamber 12. The mixing chamber 12 has two inlets—a liquid inlet 14 and an air inlet 16. A liquid pump 18 propagates liquid from the source 20 to the mixing chamber 12 via the liquid inlet 14. Likewise a separate air pump 22 delivers air to the mixing chamber 12 via the air inlet 16. The mixing chamber 12 is configured with channels 24 that facilitate mixing of the incoming liquid and air. The air flow from the air pump 22 drives the dense liquid-air mixture through several layers of porous material 26, converting the dense mixture to a free-standing foam 28. The foam 28 is then dispensed from the outlet 30.

In a preferred embodiment, the foam dispensing device 10 has an optional liquid storage unit 32. The liquid storage unit 32 features a removable liquid reservoir 34 that is releasably engagable with a receiving unit 36. The receiving unit 36 has an outer wall 38 and hollow piercers 40 and 42. The receiving unit 36 also comprises a locking mechanism 44 for mechanically restraining the removable reservoir 34 within the receiving unit 36. Here, the locking mechanism employs an inwardly-biased spring loaded clamp 46. The clamp 46 has at least two inwardly projecting jaws 48 appropriately positioned within the receiving unit 36. The liquid reservoir 34 has a projection 50 with an outwardly projecting catch 52 adapted to engage with the inwardly projecting jaws 48 of the receiving unit 36. The receiving unit jaws 48 and the reservoir catch 52 each have beveled surfaces to facilitate alignment and engagement of the reservoir 34 with the receiving unit 36.

In this embodiment, the liquid reservoir 34 has two diaphragms 54 and 56 that are impermeable to air and liquid prior to engagement with the receiving unit 36. The diaphragms 54 and 56 seal the reservoir 34 from the outer environment prior to insertion of the reservoir into the receiving unit 36. When the reservoir 34 engages with the receiving unit 36, the piercers 40 and 42 puncture the diaphragms 54 and 56. Piercing the diaphragms by hollow piercers 40 and 42 creates vent aperture 58 and liquid outlet 60. Employment of the diaphragms 54 and 56 and piercers 40 and 42 prevents leakage at the reservoir-receiving unit interface. When the liquid inside the reservoir 34 becomes depleted, the reservoir 34 can be removed from the receiving unit 36 and replaced with a new full reservoir. The jaws 48 and projection 50 cooperate to ensure a tight engagement between the liquid reservoir 34 and receiving unit 36 at the interface of each of the respective hollow piercers 40 and 42 and diaphragms 54 and 56.

This embodiment of the foam dispensing device 10 has a pump unit 62. The pump unit 62 houses a liquid pump 18, air pump 22 and a single motor 68. As can be seen most clearly in FIG. 4, the motor 68 is engaged with both the liquid pump 18 and air pump 22. The motor 68 is adapted to simultaneously power both the liquid pump 18 and air pump 22 when activated.

The liquid pump 18 is preferably a peristaltic pump. The peristaltic pump comprises a plurality of generally circular rollers that squeeze an elastic tube. The liquid disposed within the liquid channel 70 (described in detail below) propagates along the rotational direction of the rollers. Here, the pump rollers rotate in the relative direction toward the mixing chamber 12 and outlet 30 when the motor 68 is activated.

Additionally, the air pump 22 is preferably a displacement pump. Continuous rotation of the main pump axis 64 affects a continuous flow of air through the air channel 72, mixing chamber 12 and outlet 30.

As noted above, this embodiment of the foam dispensing device 10 features a liquid channel 70 positioned between and engaged with the liquid outlet 60 and the mixing chamber 12. The liquid channel 70 is adapted to transport liquid from the reservoir 34 to the mixing chamber 12 when the liquid pump 18 is in operation. When activated, the liquid pump 18 draws liquid from the reservoir 34 through the liquid channel 70 to the mixing chamber 12. Here, the liquid channel 70 is an elastic tube that permits at least some compression by the liquid pump rollers. In this embodiment, the liquid pump 18 is positioned between the respective ends of the liquid channel 70, but the device is not limited to this configuration.

Similarly, an air channel 72 is arranged between the air pump 22 and mixing chamber 12. When activated, the air pump 22 provides a steady stream of air to the mixing chamber 12 through the air channel 72. Preferably, the air pump 22 provides air at a pressure of at least about 4 psi.

Figure 2:
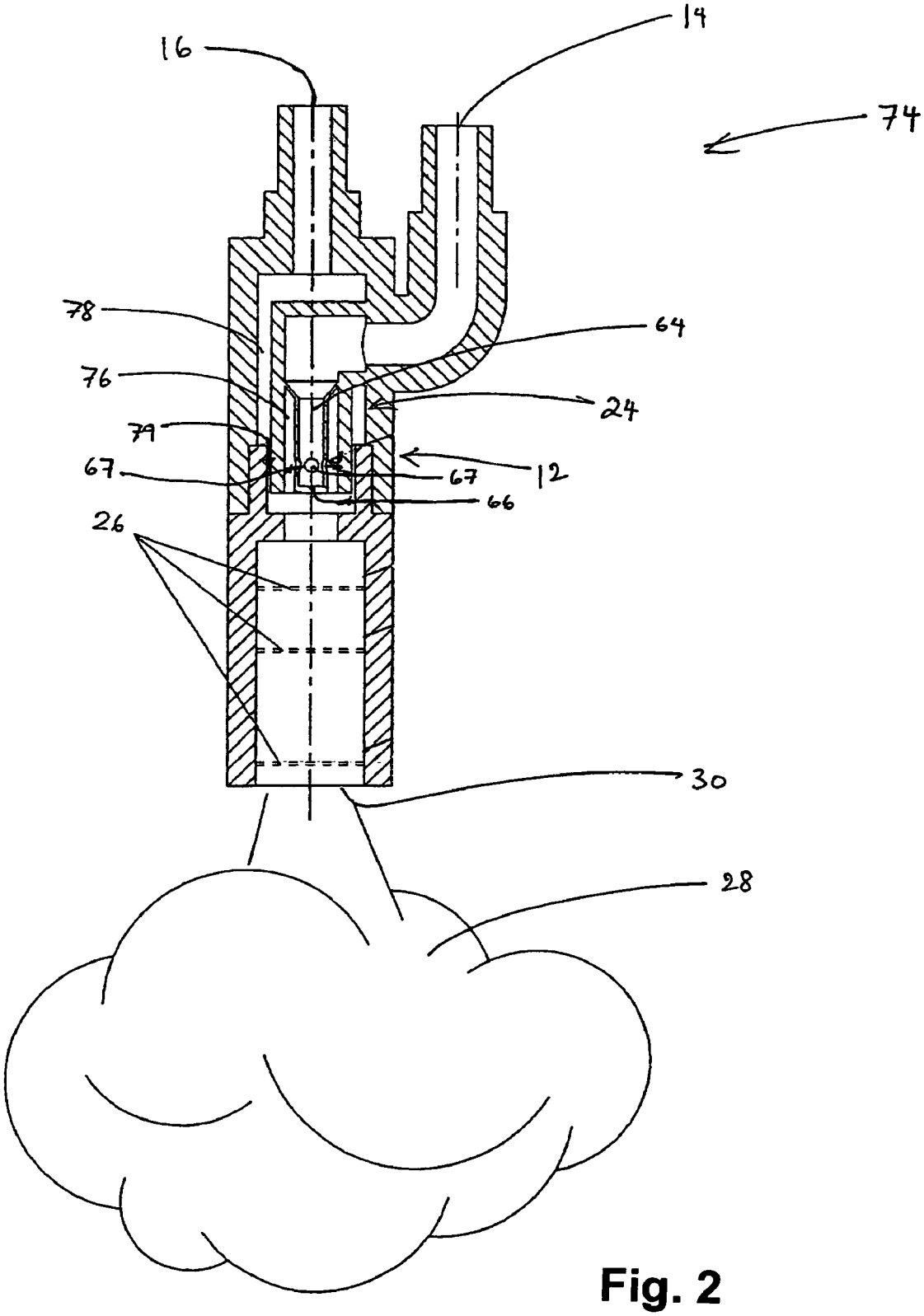
FIG. 2 is an enlarged longitudinal sectional view, partly in schematic, of the nozzle portion of the dispenser of FIG. 1.
Figure 3:
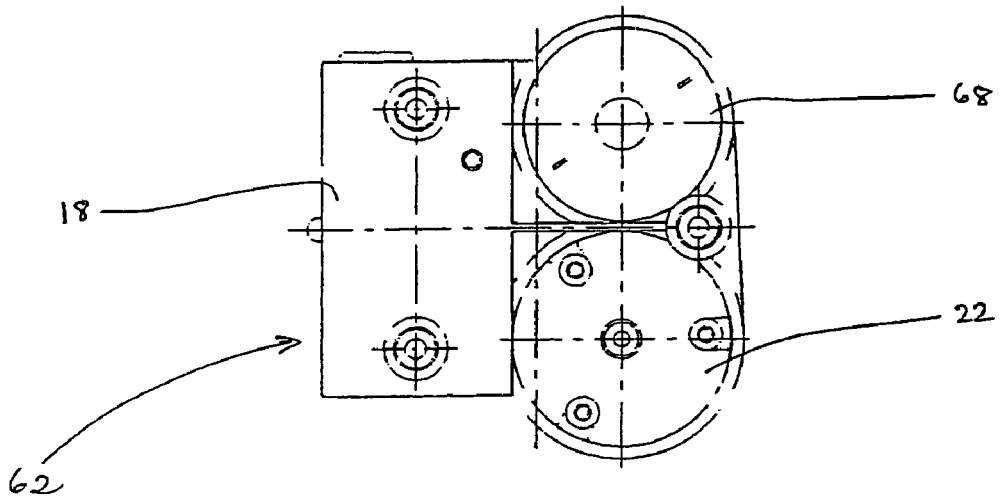
FIG. 3 is a simple plan view of a pump unit of the dispenser of FIG. 1.

The foam dispensing device 10 includes a nozzle arrangement 74. The nozzle arrangement 74 defines the mixing chamber 12 and an outlet 30. As depicted in FIGS. 1 and 2, the mixing chamber has a liquid inlet 14 and air inlet 16. The liquid inlet 14 leads to a generally cylindrical inner channel 64. The inner channel 64 is fit with a distal closure 66 and four openings 67. The inner channel openings 67 extend relatively perpendicular to each other and the inner channel 64. Each channel opening 67 connects the inner channel 64 with a generally parallel axial conduit 76. Each axial conduit 76 is open downstream from the liquid inlet 14, thus allowing the liquid to flow. The air inlet 16 leads to an air passage 78 with a narrow conduit 79. As the air pump 22 delivers air to the chamber, the air is compressed at the narrow conduit 79. The compressed air that passes through the narrow gap 79 mixes with the liquid discharged from the axial conduits 76.

Positioned between the mixing chamber 12 and nozzle outlet 30 are units of porous material 26. The units of porous material 26 are preferably comprised of multiple layers of mesh with pore sizes between about 50 μm and about 2 mm. In a preferred embodiment, the nozzle arrangement 74 includes three units of porous material 26 axially separated from each other and decreasing in porosity downstream. However, the device is not limited to this configuration.

As discussed above, the air passage 78 and narrow conduit 79 are configured to cause the flowing air to become compressed and pressurized within the mixing chamber 12. The pressurized air is then caused to counter-mix within the mixing chamber 12 with the incoming liquid that flows through the inner channel 64 and axial conduits 76 (see FIG. 2). Such counter-mixing results in a dense mixture of liquid and air. The pressure from the flowing air subsequently causes the dense liquid-air mixture to be expelled from the mixing chamber 12 through the units of porous material 26. Forcing the dense liquid-air mixture through the porous material 26 effects a conversion of the mixture to a fine foam 28. The foam 28 is then forced out of the outlet 30 by the continuous flow of air from the air pump 22. The outlet 30 is of a sufficiently wide diameter to allow the foam 28 to pass through while maintaining its form without breaking apart. The dispensed foam 28 is fine and sustainable in the air for a relatively lengthy period of time.

Figure 4:
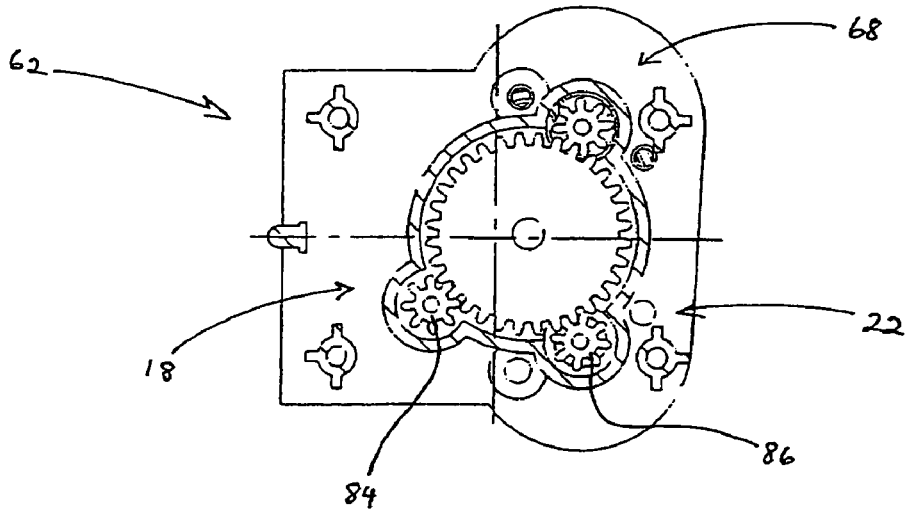
FIG. 4 is a plan view of a gear system of the pump unit of the dispenser of FIG. 1.

With reference to FIG. 4, this embodiment features a single motor 68 that drives the liquid pump 18 and air pump 22 through separate sets of transmission gears, 84 and 86. This particular arrangement triggers the pumps to engage simultaneously upon detection of motion by the detector mechanism.

Figure 5:
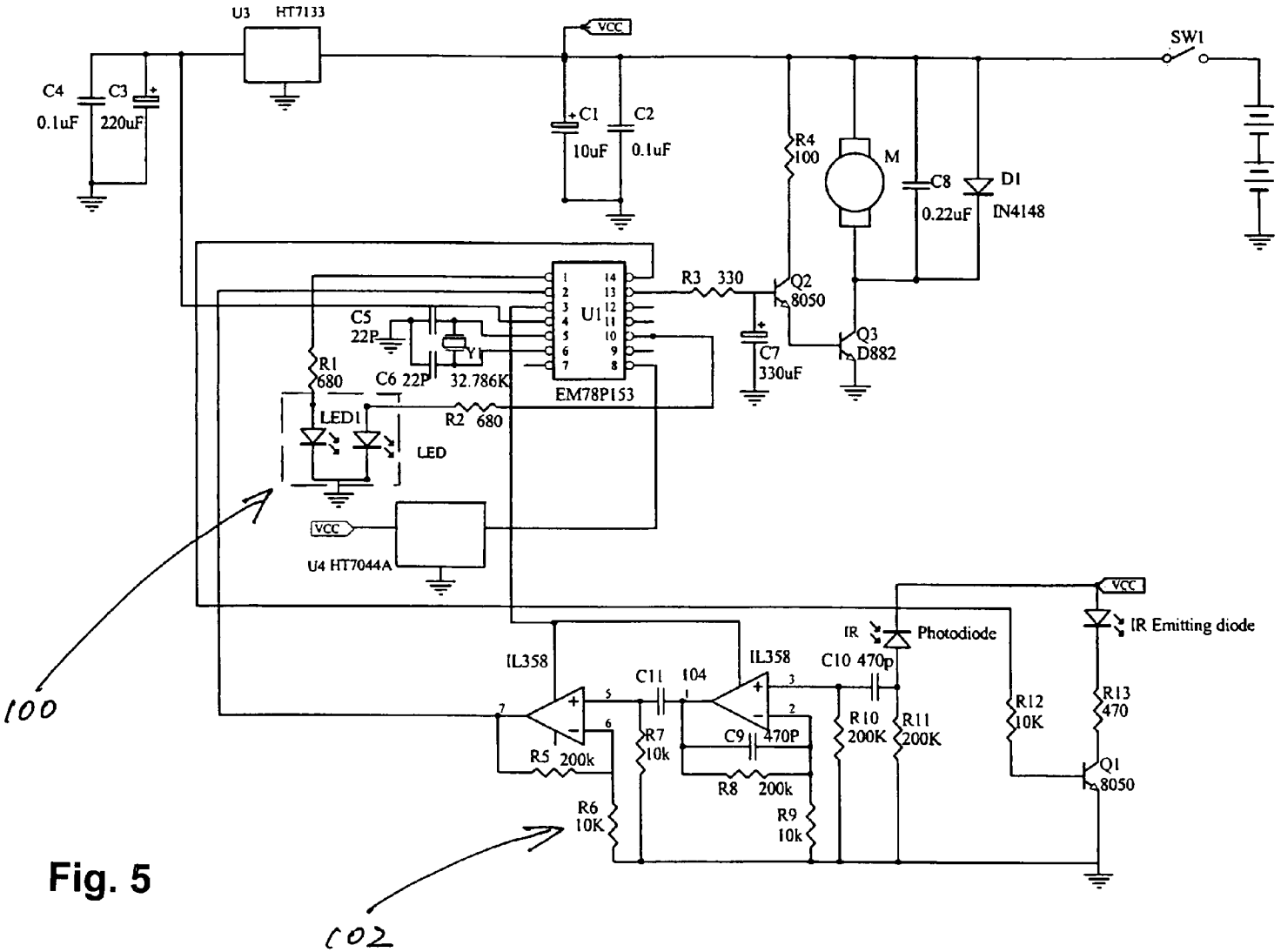
FIG. 5 is a diagram of the circuit of a break beam detector activation system for a dispenser.

One aspect of the preferred disclosed foam dispensing device 10 is that the liquid and air pumps, 18 and 22, only operate when foam production is desired by a user. In this embodiment, the single motor 68 is activated by an electronic trigger. More particularly, one embodiment features a detector mechanism for activating the motor 68. The detector mechanism detects the user's motion, for example hand motion, and then electronically triggers activation of the motor 68. The detector mechanism can be any electronic sensing circuit known in the art, such as for example, break beam detection, light reflection detection, electrostatic disturbance or the like. Break beam detection is preferred due to its low fault rate and high reliability under typical indoor lighting conditions. FIG. 5 is a circuit diagram for a circuit suitable for use with the disclosed device. As can be seen, the circuit includes an indicator 100 for indicating battery level and a break beam detector 102.

Additional decoding algorithms can be developed as appropriate to ensure effective motion detection under different lighting conditions. Here, the motor 68 is powered by an internal battery. Because the motor 68 is activated only for a short duration when foam 28 is desired by a user, the device is energy efficient. Other embodiments of the device 10 are powered via an electrical plug or feature both electrical and battery power capabilities.

Preferably, the detector mechanism is located proximate the outlet 30. A user can then effortlessly trigger the device to dispense foam into his hand simply by placing his hand underneath the outlet 30. This particular arrangement triggers the pumps 18 and 22 to be activated simultaneously and foam 28 to be produced and dispensed upon detection of motion by the detector mechanism.

While a preferred embodiment of the disclosed foam dispensing device has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A liquid foam dispenser comprising:

a liquid source in fluid communication with a nozzle defining an outlet;

a first pump adapted to propel liquid from the source to the nozzle;

a second pump for propelling air to the nozzle;

a single motor in drive engagement with both the first pump and second pump to simultaneously drive liquid and air to the nozzle when the motor is activated; and a mixing chamber positioned between the outlet and liquid source, the mixing chamber defining a liquid inlet, air inlet and a plurality of channels that initiate pressurization of flowing air and counter-mixing of liquid and flowing air therein producing a liquid-air mixture, wherein the plurality of channels comprises an outer annulus with a proximal end in communication with the air inlet and a distal end, and an inner annulus with a proximal end and a distal end, the inner annulus being connected with the liquid inlet through an inner channel, the outer annulus and inner annulus being connected at their respective distal ends via a generally circular conduit.

2. The liquid foam dispenser of claim 1, wherein the liquid source is a replaceable reservoir cartridge of liquid soap.

3. The liquid foam dispenser of claim 2, further comprising a receiving unit with a locking mechanism for locking the replaceable reservoir cartridge of liquid soap into the receiving unit.

4. The liquid foam dispenser of claim 1, further comprising an electronic trigger mechanism for activating the motor.

5. The liquid foam dispenser of claim 4, wherein the electronic trigger mechanism is activated by a motion-detecting sensor.

6. The liquid foam dispenser of claim 5, wherein the motion-detecting sensor is a break beam detector.

7. The liquid foam dispenser of claim 1, wherein the second pump delivers at least about 4 psi of air pressure.

8. The liquid foam dispenser of claim 1, wherein the first pump is a peristaltic pump.

9. The liquid foam dispenser of claim 1, wherein the second pump is a displacement pump.

10. The liquid foam dispenser of claim 1, further comprising a unit of porous material positioned between the mixing chamber and outlet, wherein the flowing air propels the liquid-air mixture from the mixing chamber through the unit of porous material.

11. The liquid foam dispenser of claim 10, wherein the porous material has pores of about 50 μm to about 2 mm.

12. A liquid foam dispenser comprising:

a mixing chamber having a plurality of channels positioned upstream of an outlet and in fluid communication therewith;

a unit of porous material positioned between the outlet and the mixing chamber;

a liquid channel delivering liquid to the mixing chamber;

an air channel delivering air to the mixing chamber;

a liquid source positioned upstream of the liquid channel;

a first pump adapted to propel liquid from the liquid source through the liquid channel to the mixing chamber;

a second pump adapted to propel air through the air channel through the mixing chamber and out the outlet; and a motor in drive communication with the first and second pumps, wherein the plurality of mixing chamber channels comprises an outer annulus with a proximal end in communication with the air inlet and a distal end, and an inner annulus with a proximal end and a distal end, the inner annulus being connected with the liquid inlet through an inner channel, the outer annulus and inner annulus being connected at their respective distal ends via a conduit, and upon activation of the motor, the first pump and second pump simultaneously propel liquid to the mixing chamber and air to the mixing chamber via the outer annulus, the mixing chamber being adapted to initiate pressurization of the flowing air therein resulting in counter-mixing of the pressurized air with the liquid, and the flowing air propels the liquid-air mixture through the unit of porous material to form a foam that is discharged from the outlet.

13. A liquid foam dispenser, comprising:

a liquid storage unit having a receiving unit with an inlet and a removable liquid reservoir releasably engagable with the receiving unit, the reservoir having an outlet aligned substantially with the receiving unit inlet when the reservoir and receiving unit are engaged;

a mixing chamber positioned between an outlet and the liquid storage unit and in fluid communication therewith;

a unit of porous material positioned between the outlet and the mixing chamber; a liquid channel delivering liquid from the liquid reservoir to the mixing chamber;

an air channel delivering air to the mixing chamber;

a first pump adapted to transport liquid from the reservoir through the liquid channel to the mixing chamber;

a second pump adapted to propel air through the air channel, mixing chamber and outlet; wherein upon activation of the motor, the first pump and second pump simultaneously propel liquid and air to the mixing chamber, the mixing chamber being adapted to initiate pressurization of the flowing air therein resulting in counter-mixing of the pressurized air with the liquid, and the flowing air propels the liquid-air mixture through the unit of porous material to form a foam that is discharged from the outlet, and wherein the receiving unit further comprises a first hollow piercer in communication with the exterior of the receiving unit and a second hollow piercer aligned with the receiving unit outlet, and the removable liquid reservoir further comprises two air and liquid impermeable diaphragms, each diaphragm being pierced by one of the hollow piercers when the reservoir is engaged with the receiving unit to form a vent aperture and a liquid channel.

14. The liquid foam dispenser of claim 13, wherein the detector mechanism is a break beam detector.

15. The liquid foam dispenser of claim 13, wherein activation of the motor is electronically triggered by a motion detector mechanism.

16. The liquid foam dispenser of claim 13, wherein the receiving unit further comprises at least one jaw and the reservoir comprises at least one projection, the at least one jaw and at least one projection cooperating to lock the reservoir into the receiving unit and ensure a tight engagement at the interface of the hollow piercers and the receiving unit.

17. The liquid foam dispenser of claim 11, wherein the porous material comprises a plurality of spaced layers having different respective porosities.

* * * * *